US009830779B2

(12) United States Patent
Veverka

(10) Patent No.: US 9,830,779 B2
(45) Date of Patent: Nov. 28, 2017

(54) GAMING TECHNIQUES

(71) Applicant: TMS GLOBAL SERVICES PTY LTD, Toowong, Queensland (AU)

(72) Inventor: Mike Veverka, Toowong (AU)

(73) Assignee: TMS GLOBAL SERVICES PTY LTD., Toowong (AU)

( * ) Notice: Subject to any disclaimer, the term of this patent is extended or adjusted under 35 U.S.C. 154(b) by 827 days.

(21) Appl. No.: 14/058,067

(22) Filed: Oct. 18, 2013

(65) Prior Publication Data

US 2014/0045569 A1 Feb. 13, 2014

Related U.S. Application Data

(63) Continuation-in-part of application No. PCT/AU2012/000726, filed on Jun. 22, 2012.

(30) Foreign Application Priority Data

Oct. 19, 2012 (AU) ..... 2012904598

(51) Int. Cl.
*A63F 9/24* (2006.01)
*G07F 17/32* (2006.01)

(52) U.S. Cl.
CPC ..... *G07F 17/329* (2013.01)

(58) Field of Classification Search
CPC ..... A63F 3/0605; A63B 71/00
See application file for complete search history.

(56) References Cited

U.S. PATENT DOCUMENTS

| | | | | |
|---|---|---|---|---|
| 5,435,602 | A | 7/1995 | Fastovsky | |
| 2003/0186734 | A1* | 10/2003 | LeMay | G07F 17/32 463/16 |
| 2004/0023709 | A1* | 2/2004 | Beaulieu | G07F 17/323 463/16 |
| 2005/0003884 | A1 | 1/2005 | Meyer et al. | |
| 2006/0105830 | A1 | 5/2006 | Nemitz et al. | |
| 2010/0273548 | A1 | 10/2010 | Bozeman | |
| 2013/0012288 | A1* | 1/2013 | Nordby | A63F 3/0605 463/17 |

OTHER PUBLICATIONS

Australian Patent Office, "Search Report" in application No. PCT/AU2012/000726, dated Sep. 6, 2012, 9 pages.
Australian Patent Office, "Search Report" in application No. PCT/AU2012/000726, dated Feb. 26, 2013, 5 pages.
Australian Patent Office, "International-Type Search Report" in applicatio No. 2011902454, dated Jun. 23, 2011, 2 pages.

* cited by examiner

*Primary Examiner* — Reginald Renwick
(74) *Attorney, Agent, or Firm* — Hickman Palermo Becker Bingham LLP

(57) ABSTRACT

In an embodiment, a computerized method for playing a lottery game comprises associating at least one electronic image with numbers and enabling the player to use said electronic image to form a combination of entry numbers for the lottery game.

13 Claims, 8 Drawing Sheets

GAMING TECHNIQUES

BENEFIT CLAIM

This application claims the benefit under 35 U.S.C. §§120, 363, 365(c) as a continuation-in-part (CIP) of international application PCT/AU2012/000726, filed 22 Jun. 2012, and claims the benefit of Australia application 2012904598, filed 19 Oct. 2012, the entire contents of which are hereby incorporated by reference for all purpose as if fully set forth herein.

TECHNICAL FIELD

The present invention generally relates to computerized gaming including lottery, keno, and bingo.

BACKGROUND

The reference to any prior art in this specification is not, and should not be taken as an acknowledgement or any form of suggestion that the prior art forms part of the common general knowledge.

Lottery is a form of gaming which involves the drawing of numbers for a prize. Some lottery players are creatures of habit and play the same combination of lottery numbers week after week. However, the Applicant has perceived that many lottery players become bored with the tedium of selecting numbers week after week, particularly when using computerized electronic gaming systems where the same numbers can be used for successive draws.

Embodiments of the present invention provide computerized gaming techniques which spark the player's interest.

SUMMARY OF THE INVENTION

According to one aspect of the present invention, there is provided a computerized method for playing a lottery game, the method including the steps of:

associating at least one electronic image with numbers; and enabling the player to use said electronic image to form a combination of entry numbers for the lottery game.

Preferably, said image is captured by a player using a smartphone or other internet connectable device The image may be a single image captured using a mobile phone or personal digital assistant (PDA) camera. The image may be a photograph. Portions of the photograph may be associated with respective numbers. The numbers may be arranged in a grid. The numbers may be sequentially arranged. The method may involve the step of the player selecting portions to, in turn, select respective numbers.

Alternatively, said at least one image may be a set (or series) of images (e.g. video). The images may be associated with respective numbers. The images (i.e. portions) of the set may be selectable by the player to, in turn, select respective numbers.

The method may further include the step of lodging a lottery ticket including the combination of entry numbers. The lottery ticket may be for multiple draws. The draws may relate to photographs of a set (e.g. vacation).

The method may involve enabling a lottery player to play online with an internet device (e.g. smart phone) connected to a server over the internet.

In one embodiment, portions of the at least one image are associated with corresponding numbers and the method further includes the step of:

associating the image portions with corresponding sounds to be emitted during lottery play.

According to another aspect of the present invention, there is provided an electronic gaming method including the steps of:

electronically associating one or more portions of at least one item personalized by a player with respective one or more win identifiers; and electronically enabling the player to select said portions of said item, and therefore associated win identifiers, to be used in determining a win.

Said item may be at least one image captured by the player using a mobile phone or personal digital assistant (PDA) camera. Said portions may be a grid cells of an image. Alternatively, each portion may be a single image of a set of images.

Said win identifiers may be numbers which are used to form a combination of entry numbers in determining a win in a lottery draw.

Said one or more win identifiers may be a single win identifier in the form of an instant prize. The method may involve the step of the player selecting a portion to reveal the instant prize.

According to another aspect of the present invention, there is provided an electronic gaming method, the method including the steps of:

electronically associating one or more nonnumeric items of a set with respective one or more win identifiers; and electronically enabling the player to select said items, and therefore associated win identifiers, to be used in determining a win.

The set may be a recipe of ingredients. The set may be a team of sports players or a league of sports teams. The set may include cities (e.g. London, Paris, Rome, etc.), vehicles (e.g. Ferrari, Porsche, etc.) or foodstuffs (e.g. carrots, tomatoes). The items may be depicted by icons.

Said win identifiers may be numbers which are used to form a combination of entry numbers in determining a win in a lottery draw.

The method may further include the step of lodging a lottery ticket. The lottery ticket may be for multiple draws. Said set (e.g. recipe) may relate to a single draw and be a subset of a larger set (e.g. banquet) relating to the multiple draws.

According to another aspect of the present invention, there is provided an electronic gaming system, the gaming system including:

an association device for electronically associating one or more nonnumeric items of a set with respective one or more win identifiers; and a selector for enabling the player to electronically select said items, and therefore associated win identifiers, to be used in determining a win.

According to another aspect of the present invention, there is provided a computerized method for playing a lottery game, the method including the steps of:

generating a selection of hidden numbers;

enabling a player to form a combination of entry numbers for the lottery game; and matching at least some of the entry numbers with the hidden numbers to generate a win.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
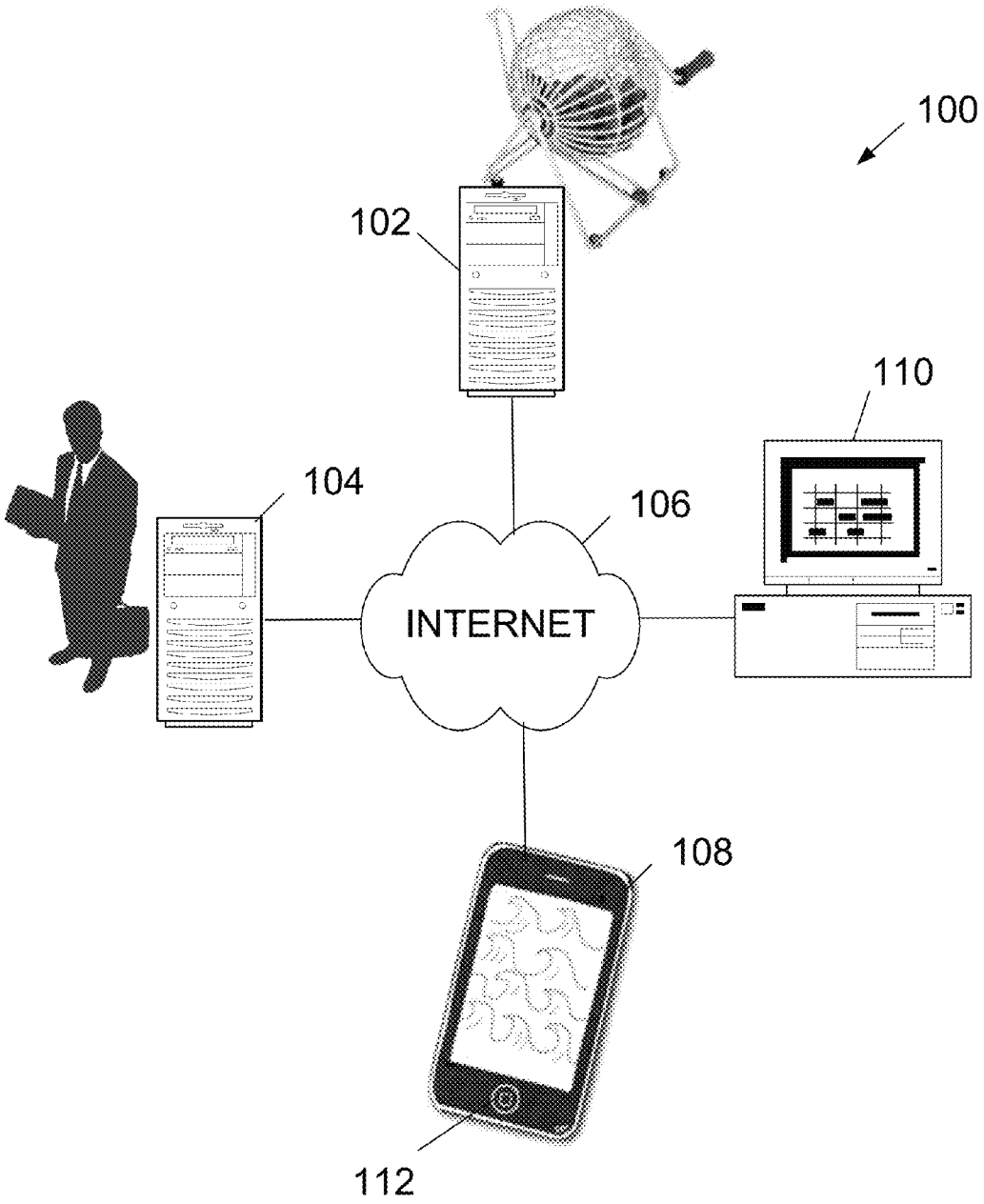
FIG. 1 is a schematic diagram of an electronic gaming system.

According to an embodiment of the present invention, there is provided an electronic gaming system 100 as shown in FIG. 1. The gaming system 100 enables association of nonnumeric items (e.g. photograph frames) of a set (e.g. video) with respective win identifiers (e.g. lottery numbers). The player can select the items, and therefore associated win identifiers, to be used in determining a win (e.g. during a lottery draw). The selection of nonnumeric items sparks the player's interest when compared with conventional number selection which can become boring. The use of photographs enables the player to personalise the gaming experience thereby adding to the player's interest and enjoyment. The system 100 is described in detail below.

Turning first to FIG. 1, the electronic gaming system 100 includes at least one lottery server 102 administered by a lottery provider (e.g. Tattersalls, South Australian Lotteries, Western Australian Lotteries, etc.) conducting at least one lottery. The system 100 further includes an agent server 104 interfaced to the lottery server 102 via the Internet 106. The agent server 104 is configured to sell tickets for the lottery online to players operating smartphones 108 and personal computers (PCs) 110. The smartphones 108 and PCs 110 are also interfaced to the agent server 104 via the Internet 106.

Figure 2:
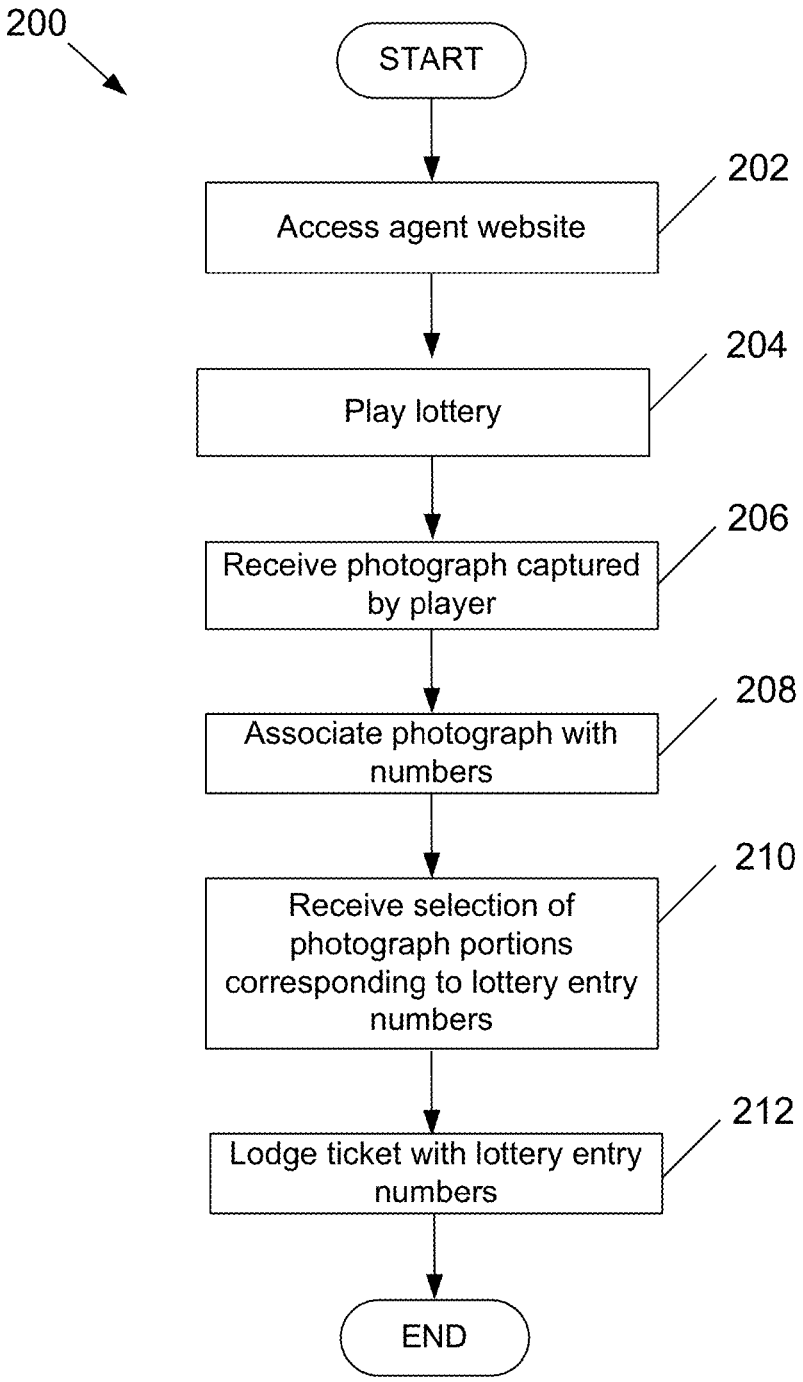
FIG. 2 is a flowchart showing a method for playing a lottery game with the gaming system of FIG. 1 in accordance with an embodiment of the present invention.

The agent server 104 hosts a gaming website. The agent server 104 executes a software product, in the form of executable machine readable instructions, to perform the method 200 for playing the lottery game described below with reference to FIG. 2.

At step 202, the player accesses the agent website hosted on agent server 104 with the smartphone 108.

At step 204, the agent server 104 receives a selection from the player indicating that the player wishes to purchase a ticket for the lottery involving the draw of a subset of numbers from a predefined set of numbers.

At step 206, agent server 104 receives a photograph 300 shown in FIG. 3 that was captured by the player using a camera 112 of the smartphone 108. The player can use the camera 112 of the smartphone 108 to capture either a single image 300 or a video of images (i.e. frames).

At step 208, the agent server 104 (i.e. association device) associates the photograph 300 with the range of numbers (e.g. 1 to 36) from which five lottery entry numbers (e.g. 1, 6, 15, 32, 36) can be selected. As can best be seen in FIG. 3*a*, an invisible grid of sequential numbers is superimposed with the photograph 300 using digital image processing techniques whereby rectangular portions 302 of the digital photograph (corresponding to cells of the grid) are associated with respective numbers. Only the photograph 300 (i.e. and not the grid or numbers) is displayed to the player on the smartphone 108 (i.e. selector). Furthermore, the agent server 104 associates the rectangular cells 302 with respective sounds (e.g. bells, whistles, etc.).

At step 210, the agent server 104 (i.e. selector) receives a selection of photograph portions 302, in turn, corresponding to a selection of respective lottery entry numbers (e.g. 6, 15, 32, 36). Referring to FIG. 3*b*, the player can select a portion of the photograph 300 (indicated by cross 304) to select a corresponding number by pressing a finger on the touch display of the smartphone 108. The smartphone 108 emits sounds responsive to selection of corresponding cells 302 which enhances the playing experience.

At step 212, the agent server 104 lodges a lottery ticket including the combination of selected entry numbers with the lottery server 102.

Another embodiment is described with reference to FIG. 4 in which the photograph 300 is replaced with a chart 400 of vegetables 402 (i.e. set of nonnumeric items or readily distinguishable icons). The lottery gaming method involves associating one or more vegetables of the chart with respective numbers (i.e. win identifiers) as before. The player can select vegetables (see crosses 404 in FIG. 4), and therefore associated numbers, to make up a soup recipe. The selected numbers can then be used in determining a win if the selected combination matches the drawn numbers by the lottery provider. The lodged lottery ticket can be for multiple games or draws whereby each recipe (e.g. entree, main, dessert, etc,) relates to a single game or draw of a banquet which makes up the entire ticket. Advantageously, the agent server 104 selects the icons, and not the lottery player.

Figure 5:
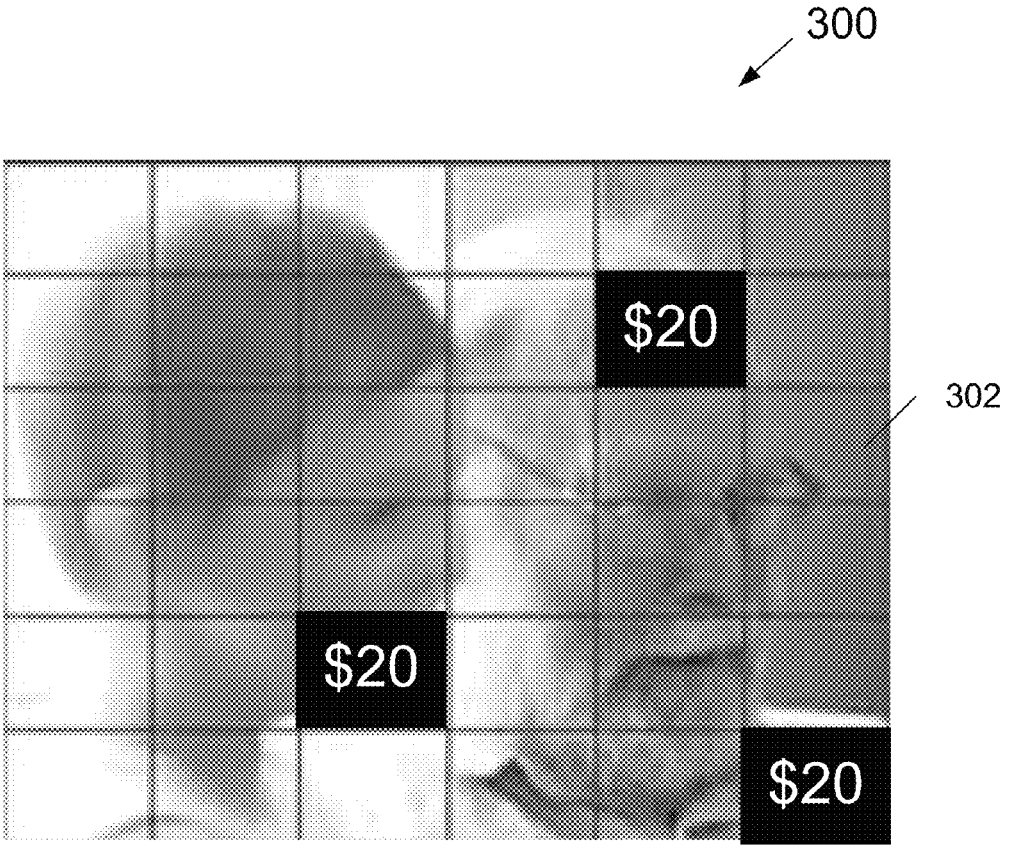
FIG. 5 is a schematic diagram showing selection of cells associated with instant-win prizes in accordance with another embodiment of the present invention.

Another embodiment is described with reference to FIG. 5 in which the photograph 300 is used in an instant win rather than a lottery game. The instant-win gaming method involves associating cell portions of the photograph 300, personalized by the player, with respective dollar amounts (i.e. win identifiers). The player can select three portions of the photograph, and therefore associated dollar amounts, to determine a win in the event that the selected dollar amounts match. As shown in FIG. 5, the player wins the dollar amount of $20 by selecting the three cell portions of the photograph 300 associated with that amount. The other cell portions are associated with other amounts.

In one embodiment, one of the cell portions of the photograph 300 may be associated with a single win identifier in the form of an instant prize represented by a "car" icon. The instant-win gaming method can involve the player selecting the cell portion to reveal the instant prize and win the car.

Figure 6:
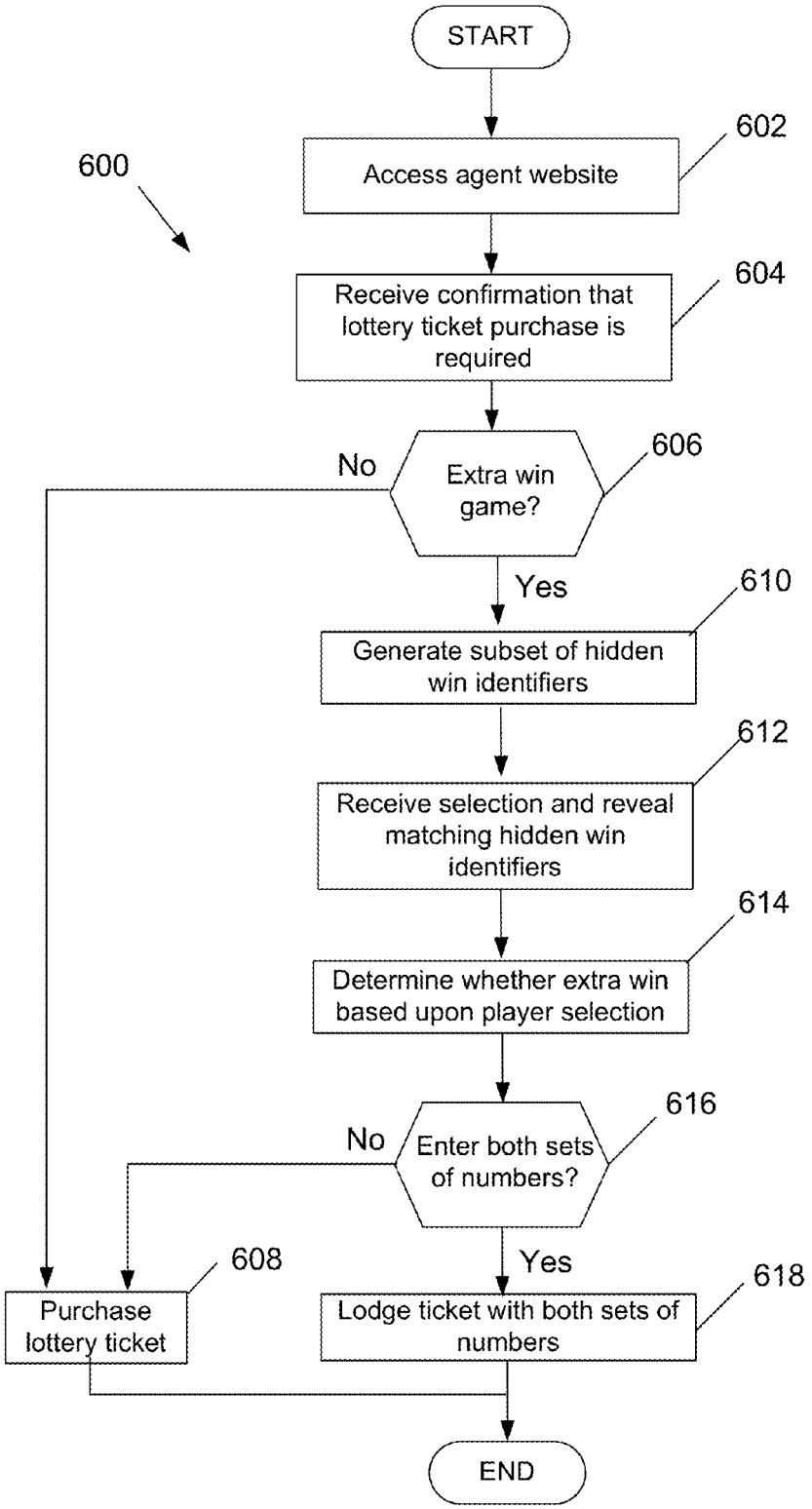
FIG. 6 is a flowchart showing a method for playing a lottery game with an extra instant win game, using the gaming system of FIG. 1 and in accordance with an embodiment of the present invention.

An alternative lottery gaming method 600 with an extra instant win game is described below in relation to FIG. 6 and FIG. 7.

At query step 602, the lottery game player accesses the agent website hosted on agent server 104 with the smartphone 108.

At step 604, the agent server 104 receives a selection from the player indicating that the player wishes to purchase a ticket for the lottery involving the draw of a subset of numbers (corresponding to vegetable icons 402 in FIG. 7*a*) from a predefined set of numbers (associated with respective vegetable icons 402 on the chart 400).

At query step 606, the agent server 104 queries whether the player wants to enter for an extra instant win game (at additional cost) in addition to the lottery ticket purchase. If not, the method 600 proceeds to step 608 where a regular lottery ticket is purchased.

Alternatively, if the player wants to enter for an extra instant win game, the method proceeds to step 610.

Figure 7A:
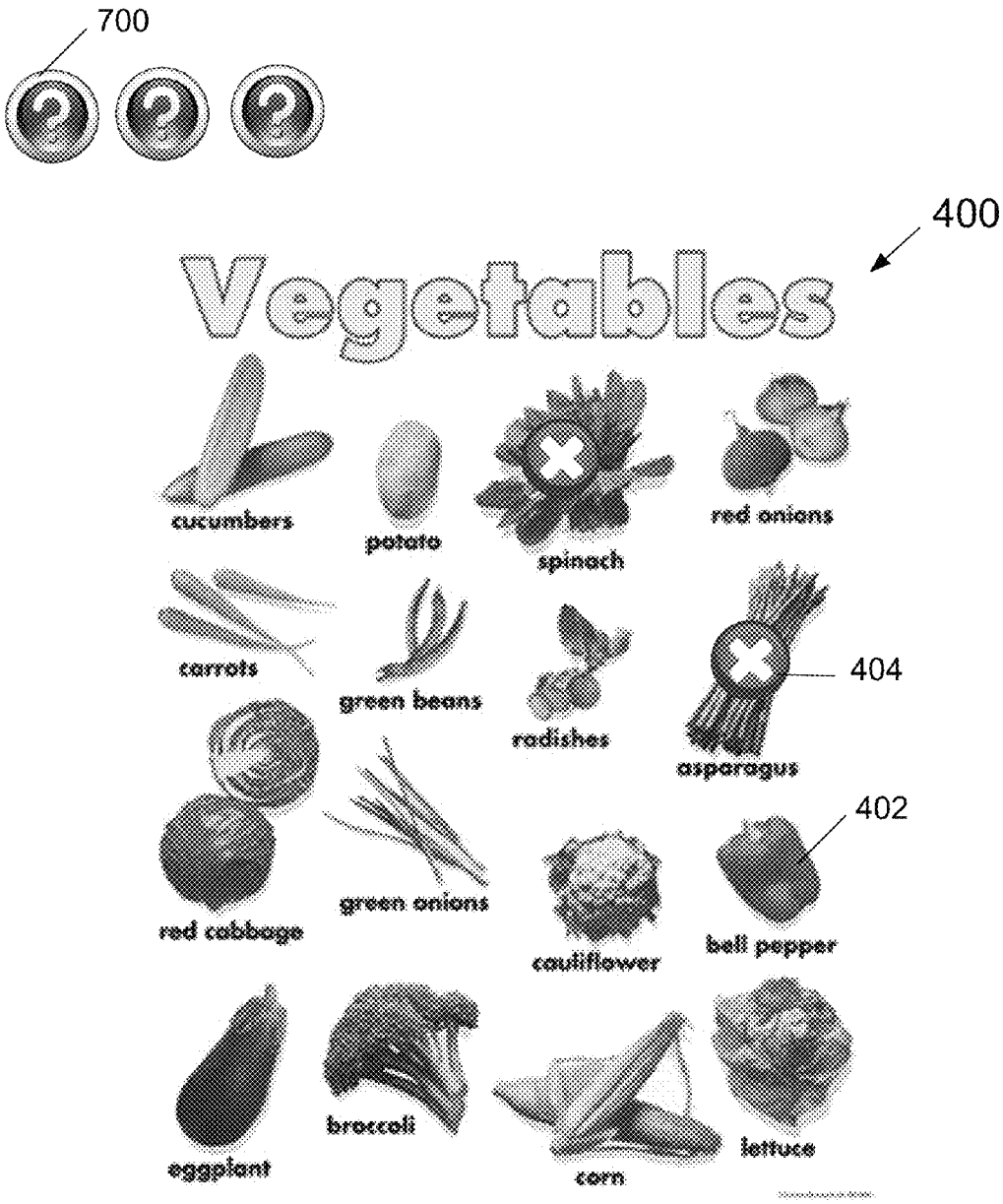
FIG. 7*a* is a schematic diagram showing an example lottery selection screen with hidden numbers when performing the method of FIG. 6.

At step 610, the agent server 104 generates and displays a random extra subset of hidden numbers 700 from the numbers corresponding to vegetables 402 in the chart 400 as shown in FIG. 7*a*.

Figure 7B:
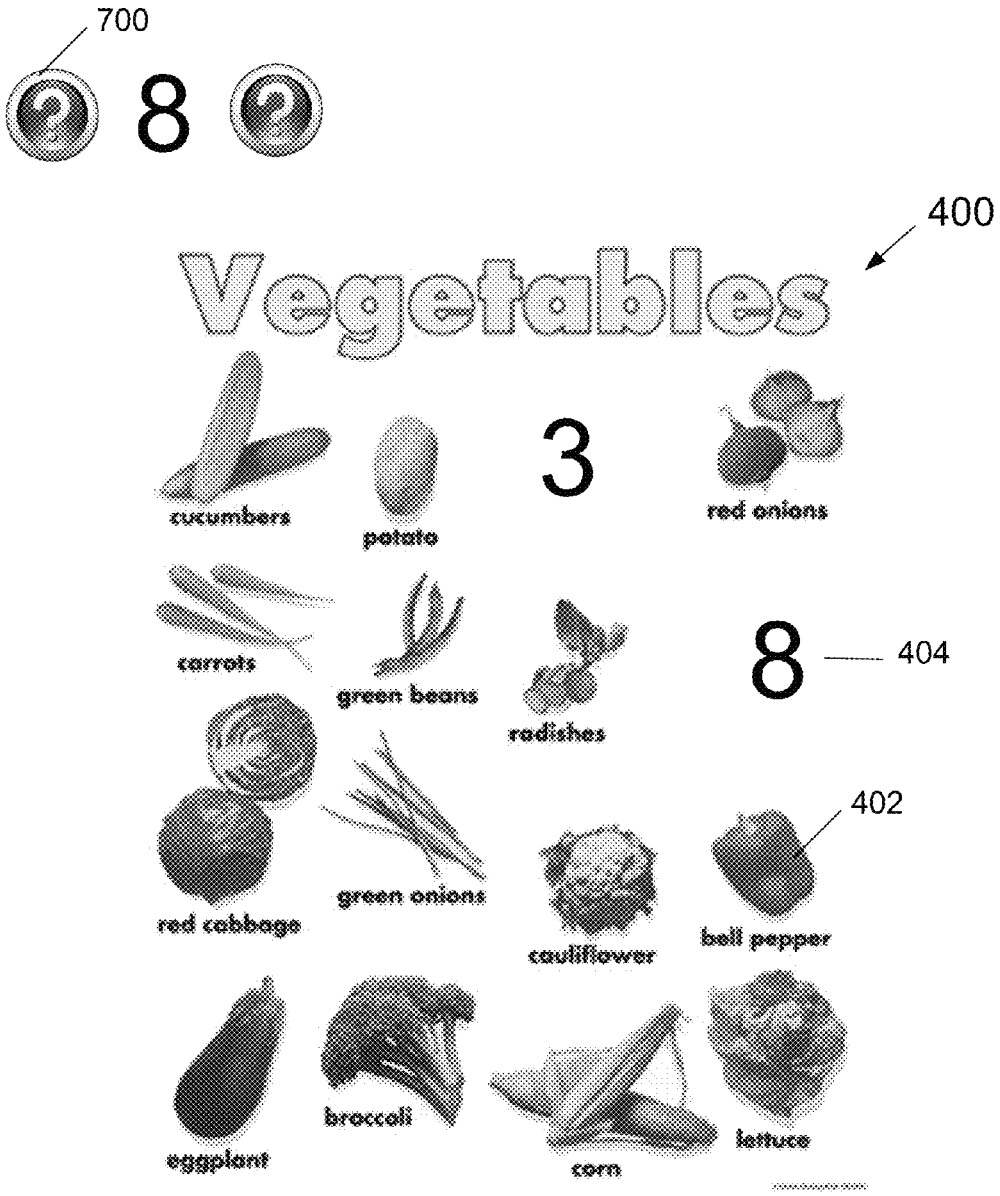
FIG. 7*b* is a schematic diagram showing the example selection screen of FIG. 7*b* with a hidden number revealed that was selected for entry into the lottery.

At step 612, the agent server 104 receives a selection of numbers corresponding to vegetables 402 in the chart 400 for entry into the lottery draw. If any selected numbers 404 match the displayed hidden numbers 700, then the hidden numbers 700 are revealed as shown in FIG. 7*b*. By way of example, the spinach and asparagus icons 402 (in FIG. 7*a*) corresponding to numbers 3 and 8 (in FIG. 7*b*) are selected by the player and the hidden win identifier 700 corresponding to the number 8 is revealed (in FIG. 7*b*). Once the icon 402 is selected, the associated number is revealed both in the chart 400 and in the hidden subset above if appropriate.

At step 614, the agent server 104 determines whether the player wins an instant prize. Typically, the extra instant win game involves the generation of six hidden numbers 700 from forty selectable numbers 402 in the chart 400. If two or more hidden numbers 700 are matched and revealed, then the agent server 104 determines that the player wins an instant prize in an increasing amount corresponding to the number of numbers 700 matched and revealed (e.g. two reveals=$2, three reveals=$3, etc.).

At query step 616, in the event that not all of the hidden numbers 700 are revealed resulting in a maximum win, the agent server 104 reveals all of the numbers 700 and queries whether the player wants to separately enter the revealed numbers 700 into the lottery draw along with the selected numbers 402 for an additional charge. If not, the single lottery ticket with the selected numbers is purchased at step 608. Alternatively, if both sets of numbers are to be entered, the method proceeds to step 618.

At step 618, the agent server 104 purchases a lottery ticket entering into the lottery draw both the revealed numbers 700 and the selected numbers 402.

A player participating in the foregoing lottery game method 600 has an increased chance of a win by participating in the extra instant win game. Although the extra win game payouts on offer may be comparatively small compared with the main lottery game payouts, they are comparable to those of instant win scratch tickets and the like which is a reasonable return from some added play (whereby you can win back the price of your tickets) thereby increasing ticket sales.

A person skilled in the art will appreciate that many embodiments and variations can be made without departing from the ambit of the present invention.

In one embodiment, the lottery game method 600 with an extra instant win game can be played using displayed numbers (rather than icons) as selectable icons 402 in a conventional manner. In one embodiment, the selectable icons 402 may be selected by simulating shooting (e.g. similar to the well-known space invaders computer game). In another embodiment, the selectable icons 402 may be fishing themed.

Figure 3A:
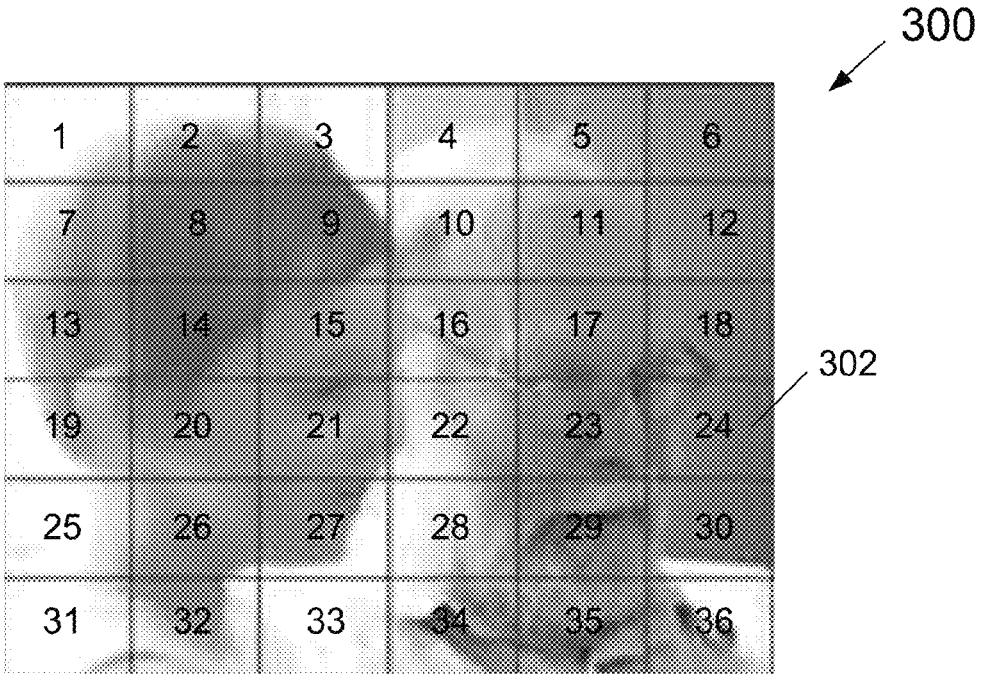
FIG. 3*a* is a schematic diagram showing a number grid associated with a photograph in accordance with the method of FIG. 2.
Figure 3B:
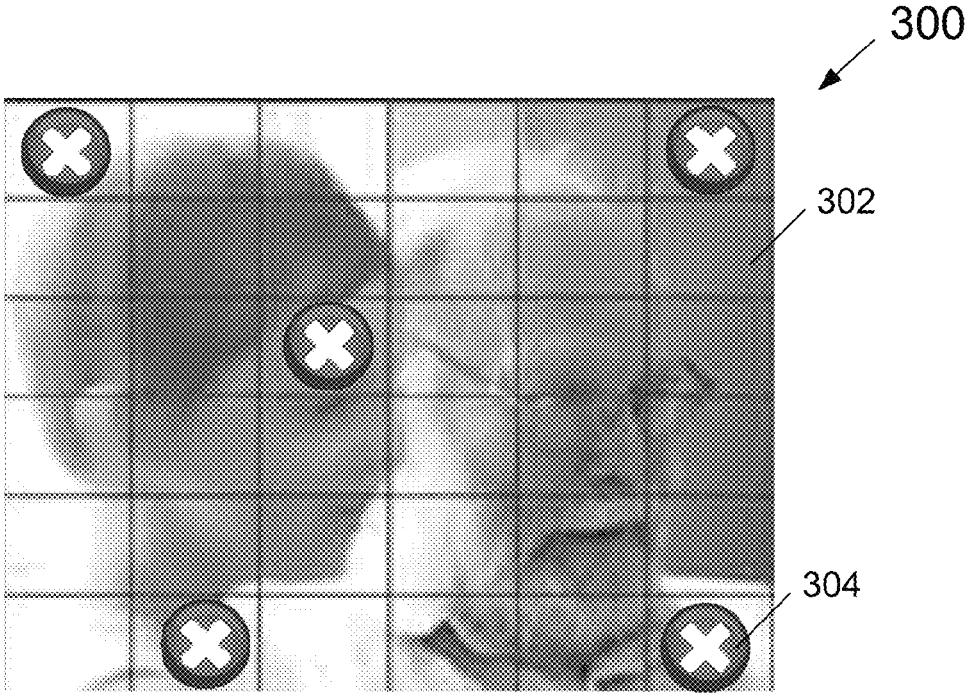
FIG. 3*b* is a schematic diagram showing selection of portions of the photograph of FIG. 3*a;*

The numbers in the grid of FIG. 3*a* were sequential. In another embodiment, the number are randomly distributed in the grid.

In one embodiment, the smartphone camera 112 may be used to capture a series of images in the form of a video at step 206. Complete images can be associated with respective numbers and the images (i.e. portions) of the video can be selectable by the player to, in turn, select respective numbers.

The lodged lottery ticket at step 212 may be for multiple lottery draws or games. In this manner, the games or draws can relate to respective photographs of a set (e.g. vacation).

Figure 4:
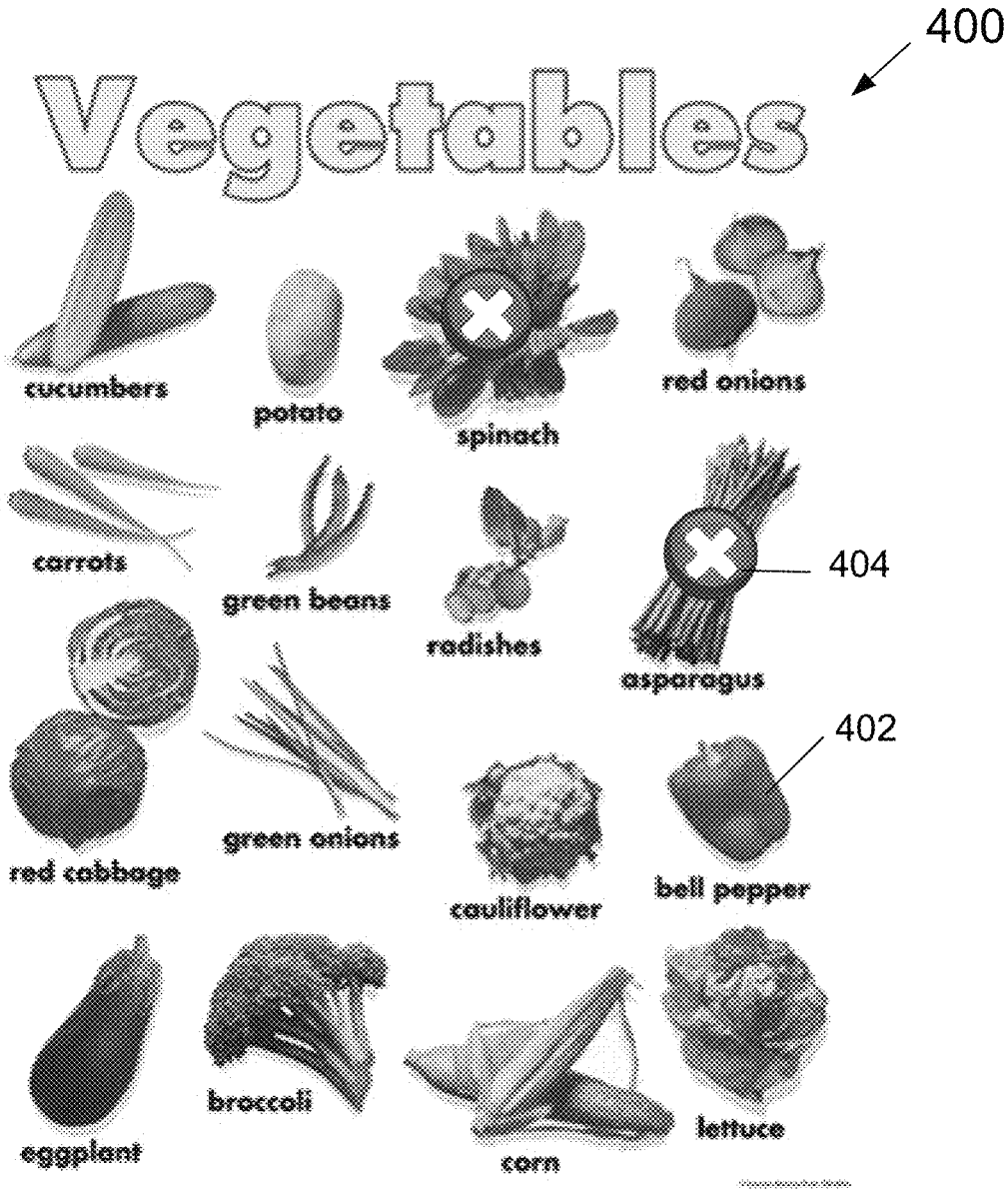
FIG. 4 is a schematic diagram showing selection of recipe ingredients and therefore associated numbers in accordance with another embodiment of the present invention.

FIG. 4 related to a nonnumerical set of items in the form of a chart of vegetables. In alternative embodiments, the set can be a team of sports players or a league of sports teams. Alternatively, the set can include cities (e.g. London, Paris, Rome, etc.), national flags, sports indicators, beverages, vehicles (e.g. Ferrari, Porsche, etc.) or foodstuffs (e.g. fruit, fast food, etc). The items are typically depicted by icons.

In one embodiment, the photograph 300 may not be captured by the player and can instead be selected from a range of images so that he player can still personalize the game to their liking.

In one embodiment, the agent server 104 may be omitted from the gaming system 100 whereby the lottery server 102 instead performs all of the steps of the method 200. In this manner, the lottery server 102 conducts the lottery and sells gaming tickets to the public directly without the need for an agent. Accordingly, the gaming system 100 may include one or more servers.

The lottery can be a governmental lottery or a private lottery.

In one embodiment, a lottery player's computer emits sounds corresponding to cells 302 responsive to a mouse pointer being coincident with the displayed cells 302, whether or not those cells are actually selected as inputs for the lottery draw.

In compliance with the statute, the invention has been described in language more or less specific to structural or methodical features. It is to be understood that the invention is not limited to specific features shown or described since the means herein described comprises preferred forms of putting the invention into effect.

What is claimed is:

1. A computerized method for playing a lottery game, the method including the steps of:

capturing, by a player using a smartphone or other internet connectable device, an electronic image;

associating portions of the electronic image with numbers; and enabling the player to use said electronic image to form a combination of entry numbers for the lottery game, wherein said at least one electronic image is a set or series of video images.

2. A method as claimed in claim 1, wherein the image is a photograph image.

3. A method as claimed in claim 2, wherein the numbers are sequentially arranged in a grid.

4. A method as claimed in claim 2, further involving the step of the player selecting portions to, in turn, select respective numbers.

5. A method as claimed in claim 1, further including the step of lodging lottery tickets for multiple draws, the draws relating to photographs of a set.

6. A method as claimed in claim 1, wherein the electronic image is personalized by a player.

7. A method as claimed in claim 1, further including the step of:

associating the image portions with corresponding sounds to be emitted during lottery play.

8. A method as claimed in claim 1, further including the steps of:

generating a selection of hidden numbers; and matching at least some of the entry numbers with the hidden numbers to generate an instant win.

9. An electronic gaming system, the gaming system including:

an association device for electronically associating portions of an electronic image with respective win identifiers; and a selector for enabling the player to electronically select said portions, and therefore associated win identifiers, to be used in determining a win, wherein the electronic image is captured by a player using an internet connectable device.

10. An electronic gaming system as claimed in claim 9, including:

a server hosting a website, and including the association device and the selector; and the internet connectable device by which a player can access the website to use the association device and selector.

11. A computerized method for playing a lottery game, the method including the steps of:

generating a selection of hidden numbers;

capturing, by a player using a smartphone or other internet connectable device, an electronic image;

associating portions of the electronic image with numbers;

enabling a player to form a combination of entry numbers for the lottery game using the electronic image; and matching at least some of the entry numbers with the hidden numbers to generate a win.

12. A computerized method for playing a lottery game, the method including the steps of:

capturing, by a player using a smartphone or other internet connectable device, an electronic image;

associating portions of the electronic image with numbers; and enabling the player to use said electronic image to form a combination of entry numbers for the lottery game, wherein the electronic image is personalized by a player.

13. A computerized method for playing a lottery game, the method including the steps of:

capturing, by a player using a smartphone or other internet connectable device, an electronic image;

associating portions of the electronic image with numbers;

enabling the player to use said electronic image to form a combination of entry numbers for the lottery game; and associating the image portions with corresponding sounds to be emitted during lottery play.

* * * * *